United States Patent [19]

Fehlhafer

[11] Patent Number: 5,042,568

[45] Date of Patent: Aug. 27, 1991

[54] ADJUSTABLE RADIATOR MOUNTING SYSTEM AND CORE HAVING SELECTABLE HOSE CONNECTIONS

[76] Inventor: Michael S. Fehlhafer, 152 Nebraska St., Utica, Nebr. 68456

[21] Appl. No.: 468,014

[22] Filed: Jan. 22, 1990

[51] Int. Cl.[5] ..... F28D 1/04

[52] U.S. Cl. ..... 165/51; 165/76; 165/69; 165/149; 180/68.4; 123/41.49

[58] Field of Search ..... 165/51, 148, 149, 76, 165/78, 69; 180/68.1, 68.4; 123/41.48, 41.49

[56] References Cited

U.S. PATENT DOCUMENTS

| | | | |
|---|---|---|---|
| 942,677 | 12/1909 | Smith et al. | 165/69 |
| 1,593,242 | 7/1926 | Cutler | 180/68.4 |
| 1,827,781 | 10/1931 | Church | 165/76 |
| 2,188,245 | 1/1940 | Middleton | 165/51 |
| 2,286,398 | 6/1942 | Young | 180/68.4 |
| 2,488,804 | 11/1949 | Christensen | 165/149 |
| 3,093,189 | 6/1963 | Panthofer | 165/69 |
| 3,700,061 | 10/1972 | Hortnagl | 180/68.4 |
| 4,036,288 | 7/1977 | Neveux | 165/69 |
| 4,367,793 | 1/1983 | MacIntosh | 180/68.4 |
| 4,382,464 | 5/1983 | Melnyk | 165/76 |

FOREIGN PATENT DOCUMENTS

| | | | |
|---|---|---|---|
| 2137121 | 2/1973 | Fed. Rep. of Germany | 180/68.4 |
| 3607754 | 9/1987 | Fed. Rep. of Germany | 165/76 |
| 1490132 | 10/1977 | United Kingdom | 180/68.1 |

*Primary Examiner*—John K. Ford

*Attorney, Agent, or Firm*—Zarley, McKee, Thomte, Voorhees & Sease

[57] ABSTRACT

A radiator mounting system for connecting a radiator to an engine having hose sizes and having hose attachment locations not designed for that radiator. Four radiator hose ports of a special radiator housing hereof are each provided with identical adjacent bolt holes for selectively attaching, across any one hose port, either a blocking plate or a hose-receiving-neck, each selected to fit an engine hose. A radiator support has columns attached to a radiator housing in an adjustable manner for vertical positioning of the radiator with respect to the engine fan. The mounting system and radiator provide a pre-constructed product with built-in vibratory protection for the radiation coils.

2 Claims, 1 Drawing Sheet

ADJUSTABLE RADIATOR MOUNTING SYSTEM AND CORE HAVING SELECTABLE HOSE CONNECTIONS

FIELD OF THE INVENTION

This invention is in the field of ways to connect radiators to engines. Its main use is in the field of stationary engines rather than those for the propelling of vehicles. An important example of such use would be on engines for driving irrigation pumps.

BACKGROUND OF THE INVENTION

In the past, operators of irrigation pump engines and other stationary engines have had difficulty in finding radiators to fit their engines after a previous radiator has failed. Sometimes such radiators have lasted for decades and now the owner finds that his engine is so obsolete that no one supplies a radiator that will fit his engine.

Such radiators as are often found available are not designed for stationary engines but are designed for propulsion of highway vehicles where vehicle motion assists cooling.

Usually, after much searching, the operator selects a radiator. Often the only radiators he can find are of other brands and of mismatched sizes. The hose connections are then often in unmated location with respect to the engine hose connections.

It is common for a farmer to replace a radiator with one that is not adequate, resulting in radiator breakdown in three of four years when an adequate radiator could have lasted for decades.

Because of the unavailability or excess cost of a radiator factory-mated to his engine, a stationary engine user must often couple large hoses to smaller fittings, and vice versa, by using a series of size-reducers of the double-ended threaded socket type interconnected by threaded nipples.

Such a many-jointed substitute "make-do" has many threaded connections, which can come to leak under the constant engine vibration as the years pass. As stationary engines are often in remote, seldom supervised places, this leakage continues undetected, and engines are ruined from coolant leakage and overheating. The system hereof seeks to eliminate such waste and public loss.

It is therefore a primary object of this invention to provide a cooling system so readily adaptable as to fit so many types and sizes of engines that it becomes economically practical for a company selling radiators (1) to keep a far lesser sized inventory of radiators and (2) yet satisfy the customer's much varying needs much better. This causes it to become economically practical, with this system, to sell a radiator with a safely large extra cooling capacity, thus fitting a range of both smaller and larger engines.

Such economical practicality is partly because of the time saved at installation. The radiator installation system hereof requires no welding, no cutting and no drilling in the installation stage. One size radiator stocked, can be large enough to fit engines varying greatly in radiation needs. When the single size is larger than necessary, the extra cost is more than balanced by low installation costs, and by lower dealer radiator inventory needs, because of the versatility of fitting many engine sizes and models.

Tests have shown that the cooling system hereof, having a pre-constructed unitary radiator, radiator housing, and housing support assembly, can be mounted on an engine by a workman of average ability in one hour, and by some workmen in as little as thirty to forty-five minutes. This compares with about five hours for a good workman to mount an off-the-shelf radiator to which a housing and housing support must yet be attached. This is a reduction of installation time to one-fifth or less.

With the cooling system hereof installed, if a radiator should be blown and destroyed, then a new radiator can be put in place by working with only eighteen bolts and two hose clamps. Only two bolts for each hose connection are needed.

Much down-time is experienced with breakdowns, with difficulties of slow radiator delivery and time-consuming shopping trips to locate special radiators for special engines, problems this invention seeks to eliminate.

Some pump engines are concerned with life and death itself such as for pumping oxygen in the mining industry. Breakdowns are most serious. An objective is to make it more affordable to reduce breakdown and to greatly reduce the necessity for radiator replacement. farmers ought not to gamble on installing radiators themselves. As farmers are not well enough informed about radiators they often make bad choices, or they mount a radiator with methods that cannot withstand the prolonged periods of vibration.

An objective is to provide a cooling system installable without any shimming, and without any special building. Engine hose size is determined for selecting alternative easily adapted hose necks.

Another objective is to provide a system easily installed by the farmer operator himself, without need for specially tranined radiator installers.

A futher objective is to provide the customer of a radiator shop with a possibility of one-stop-satisfaction without having to hunt from shop to shop for a special radiator, not even having to do careful measuring for the most part.

An objective is to provide a system which is well cushioned to protect against vibration damage.

An objective is to provide great versatility not only at the connections between the hoses and hose ports but also great versatility is provided by using slots for vertical adjustment of the radiator so that its fan opening is in exactly the right place for the engine that it is used with.

Although slots for versatile adjustment are used in many fields of mechanics, yet no one has been able to conceive of a use of slotted connections for radiator mounting.

Another objective hereof is to reduce engine-down-time caused by radiator failure.

IN THE DRAWINGS

The radiator housing portion is shown in a horizontal section. The neck attached to it and a gasket between the housing and the base of the hose neck are both seen from the top with the portions broken away and showing the bolts extending therethrough.

DESCRIPTION OF THE PREFERRED EMBODIMENT

Figure 1:
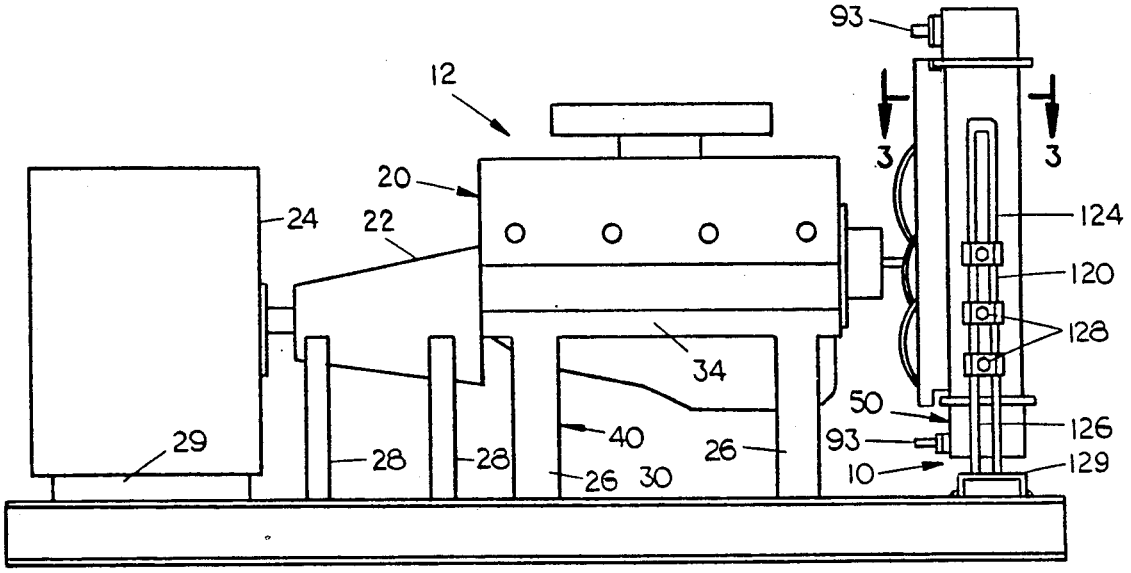
FIG. 1 is a left side elevation of an engine and radiator assembly shown connected to an irrigation pump by a transmission, all being on a same skid.
Figure 2:
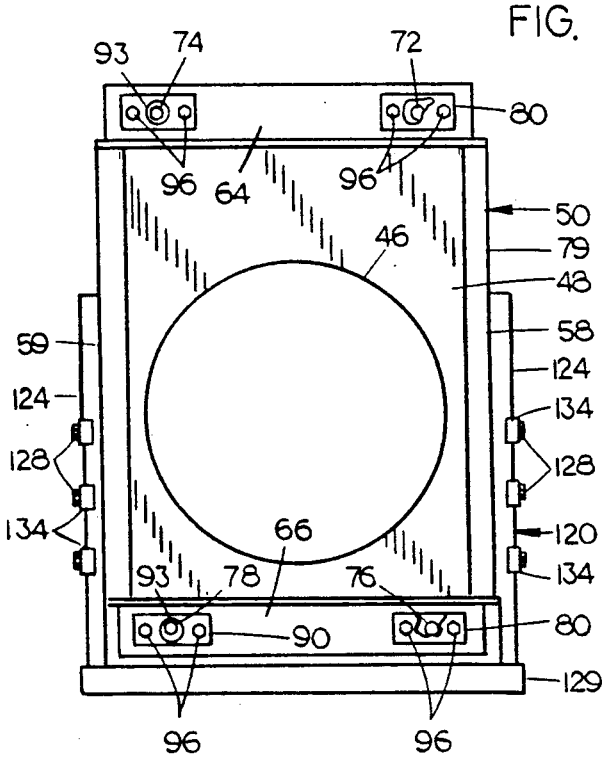
FIG. 2 is a diagrammatic view rear elevation of the special radiator hereof but without showing the coils.

The radiator mounting system of this invention is generally indicated at 10 in FIG. 1 and is for use with an engine and radiator assembly generally indicated at 12 in FIG. 1.

The engine and radiator assembly 12 has an engine 20 which can have a transmission 22 driving a load 24 which can be an irrigation pump. The engine 20 is supported on posts 26 attached to the upper side of the skid 30 and the transmission 22 and the pump 24 are likewise mounted on posts 28 and 29 respectively supported by the skid 30.

The engine posts 26 are connected at their upper ends by right and left braces only one of which is shown at 34 in FIG. 1. The posts 26, skid 30, and braces 34 can all be considered part of an engine frame indicated at 40.

The fan of the engine 20 is seen at 44 and is received in the large opening 46 in the rear wall 48 of a radiator housing 50 which is a part of the radiator system generally indicated at 10.

The radiator housing 50 has a forward wall 56 and right and left sidewalls 58 and 59, and contains a radiator core which is generally indicated at 60 but not specifically illustrated because the mounting system of this system can be used effectively regardless of what type of core is used in the radiator.

The radiator has a top tank or header 64 and a bottom tank or header 66 as is common as such headers commonly have two ports each, the upper header 64 having a right port 72 and a left port 74 and the lower header 66 having a right port 76 and a left port 78.

Figure 3:
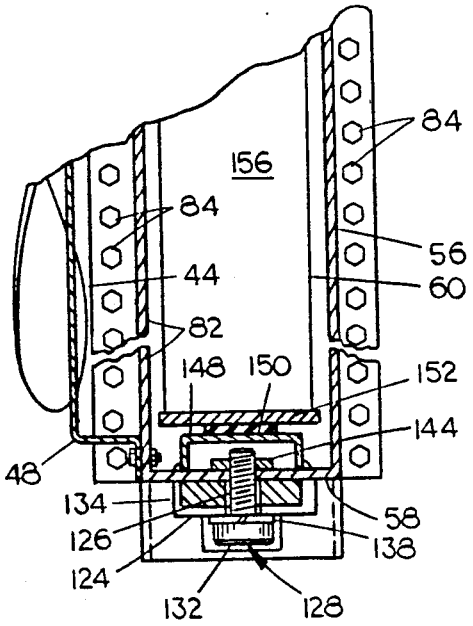
FIG. 3 is a diagrammatic view along the line 3—3 of FIG. 1 but with the upper end of a column, and a left portion of the special radiator hereof, broken away. The radiator coils are not shown as the system hereof can serve with coils of any type.

The headers or tanks 64 and 66 are each removably attached to a central part 79 of the radiator housing 50 by bolts 84, which are mostly not shown, except in FIG. 3. The headers are bolted on for further versatility in radiator coil substitution and for ease of repair.

Figure 4:
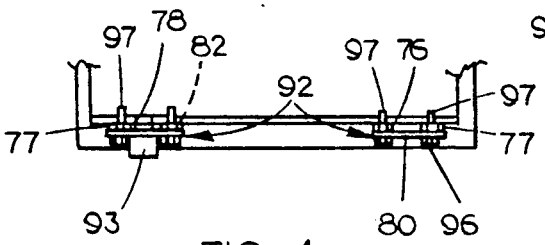
FIG. 4 is a diagrammatic view of a rearward portion only of the top radiator header or tank showing the ports thereof by the breaking away of the top part of the top header. Parts forward of the rear header wall are broken away.

As in FIG. 4, each of the ports 72, 74, 76 and 78 are surrounded by a gasket 77.

Two of the ports, such as the right ports 72 and 76, as shown in FIG. 3, are each covered by one of two blockers or closures 80.

A second two of the ports, such as the ports 74 and 78 of FIG. 3, can be each covered by one of two hose-attaching necks 90.

Each neck 90 has a base 92, and having a cylindrical rearward tubular portion 93 for receiving, thereon, one of two hoses, now shown, for putting the engine 20 in communication with the respective header port 74 or 78.

The closures 80 and necks 90 can be called porters as they extend across the ports 72 and 78. Each porter has two or more porter-bolt holes 82 therethrough. The holes 82 can also be called, alternately, holes 82, or first fastening elements 82.

Figure 5:
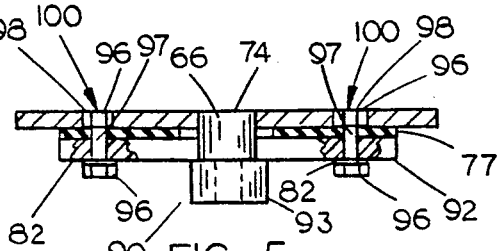
FIG. 5 is a detail of only one neck and a portion of the radiator housing.

The porter-bolt holes 82 can each receive therethrough one of eight porter-bolts 96 which are anchored, threadedly, to the respective radiator housing top or bottom header 64 or 66 in any suitable manner. This can be done, for example, by means of providing header holes or recesses 97 in the respective header 64 or 66, as best seen in FIG. 5, with the wall of each header hole or recess 97 threaded for attachment to the respective porter-bolt 96.

Eight housing holes 98 are used of which two are adjacent each port 72 or 78 and on opposite sides thereof, each receiving a porter-bolt 96.

Each porter-bolt 96 can be called a second fastening element 96 and each housing hole 98, with its threads, can be called a third fastening element 98. Each mated-first, second, and third fastening elements together define a securing unit, each generally indicated at 100 and of which there are two securing units 100 per each closure 80 or neck 90.

The securing units 100 are each so made and positioned that any closure 80 can be substituted for any neck 90, at any port 74 or 76, using any two of the securing units 100.

Therefore, a dealer, by supplying selected necks 90 from an inventory of necks of various sized tubular portions 93 and by supplying a special mass produced radiator hereof can quickly satisfy the special needs of many.

The interfitting of the special radiator 50 hereof to various engines as to alignment with the engine fans is assisted by a radiator support 120 hereof, which as seen in FIG. 1, has right and left columns 124, welded at their lower ends to a hollow horizontal foundation 129 seen in FIG. 1 and fixed, in any suitable manner, to the skid 30.

Each column 124 has a vertical slot 126 therethrough receiving respective column-bolts 128 with heads 132 each engaging the outer side of a C-shaped bracket 134 which spans the respective column and snuggly but slidably engages its forward and rearward sides.

A lockwasher 138 is between each bolthead 132 and the respective bracket 134.

The inner end of each bolt 128 is threadedly attached to the sidewall 58 or 59 of the radiator housing 50 by any suitable means such as by reinforcing with a threaded nut 144 attached to the inner side of the respective housing sidewall 58 or 59.

In FIG. 3, the inner side of the housing wall 58 has a bridge 148 across the inner end of the bolt 128 and having on its inner side a coil-carrier-facing resilient vibration reducer 150 engaging a coil-carrier sidewall 152, separating the vulnerable coils, not shown, but in an area 156, from engine vibration coming through the skid 30 and the support 50.

I claim:

1. A radiator mounting system, comprising:

a radiator having a housing with an opening in a rearward side to be placed in alignment with an engine fan, said radiator having right and left sides and a hollow interior for holding coolant;

said radiator having an upper tank and a lower tank; said upper and lower tanks each having a pair of spaced-apart identical hose ports on the rearward side thereof;

first closure means selectively removably connected to one hose port on the upper tank;

second closure means selectively removably connected to one hose port on the lower tank;

a first tubular neck member selectively removably connected to one hose ports on the upper tank;

a second tubular neck member selectively removably connected to one hose ports on the lower tank;

means for selectively and interchangeably connecting said closure means and neck members to said hose ports;

said radiator having a cooling coil carrier;

first and second stiff bridges mounted on the interior of said right and left sides of said radiator housing, said bridges having central portions which arch interiorly away from said radiator housing sides toward said cooling coil carrier; and a resistant vibration reducer mounted between said bridges and said cooling coil carrier, to support said cooling coil carrier between said radiator housing sides and dampen vibrations.

2. A radiator and mounting system for connecting a radiator to an engine, the system comprising:

a radiator having a housing having a large opening in its rearward side to be placed in vertical alignment with an engine fan, said radiator housing having right and left sides, two closure means attached each to a different header and each covering a hose port, two necks each attached to one of said headers, each neck having a tubular portion extending away from the respective header, said necks each having a base portion, each base portion extending respectively across a port in a different one of said headers;

said base portions being attached to said headers respectively and to said tubular portions respectively, each base portion having a coolant flow hole therethrough for capability of coolant flow between any one of said tubular portions and a respective port, said closure means and said necks being each removably secured to the respective said header by bolt means, said closure means and said necks each defining a porter whereby there are four porters, each of said porters being provided with at least two porter-bolts adjacent a respective one of said ports, said porter-bolts extending forwardly from the respective porter base, said headers each having at least two header recesses adjacent each of their said ports respectively, said header recessed receiving respective porter-bolts, the positions of said recesses and the positions of said porter-bolts being such that the header recesses by any one of said ports can receive the porter-bolts of any one of said porters whereby at each port either a closure means or a neck can be interchangeably used for versatility of fitting said radiator on any one of many sizes and brands of engines, said radiator having a cooling coil carrier, said header recesses each opening toward a rearward side of each of said headers, a stiff bridge fixed to the inner side of said radiator housing and having a central portion which arches across an inner side portion of said housing at one of a plurality of recesses formed in a radiator support in a position for capability of reducing vibration coming from said radiator support toward said cooling coil carrier, a resilient radiator coil-protecting vibration reducer mounted on the inner side of said bridge and between said bridge and said coil carrier so as to be pre-assembled into said system before the interconnection of said housing and an engine.

* * * * *